US008960507B2

(12) United States Patent
Sciole

(10) Patent No.: US 8,960,507 B2
(45) Date of Patent: Feb. 24, 2015

(54) PUMP DISPENSER WITH AN INCLINED NOZZLE

(75) Inventor: Joseph Sciole, Fort Wayne, IN (US)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 13/280,715

(22) Filed: Oct. 25, 2011

(65) Prior Publication Data

US 2013/0098943 A1 Apr. 25, 2013

(51) Int. Cl.

| | |
|---|---|
| ***B65D 5/72*** | (2006.01) |
| ***B05B 1/34*** | (2006.01) |
| ***B05B 11/00*** | (2006.01) |
| ***B05B 15/02*** | (2006.01) |
| *B05B 15/06* | (2006.01) |

(52) U.S. Cl.

CPC ..... *B05B 1/34* (2013.01); *B05B 11/0064* (2013.01); *B05B 11/0089* (2013.01); *B05B 11/3001* (2013.01); *B05B 11/3047* (2013.01); *B05B 11/3097* (2013.01); *B05B 15/02* (2013.01); *B05B 15/065* (2013.01)

USPC ..... 222/571; 222/321.9

(58) Field of Classification Search

USPC ..... 222/320, 321.1, 321.2, 321.3, 321.7, 222/321.9, 571

See application file for complete search history.

(56) References Cited

U.S. PATENT DOCUMENTS

| | | | | | |
|---|---|---|---|---|---|
| 778,757 | A | * | 12/1904 | McCahill | 222/321.9 |
| 958,871 | A | * | 5/1910 | Helmer | 222/129.3 |
| 1,522,370 | A | * | 1/1925 | Thacher | 222/321.3 |
| 1,575,767 | A | * | 3/1926 | Jackson | 222/375 |
| 2,106,197 | A | * | 1/1938 | Widebour | 141/215 |
| 2,519,640 | A | * | 8/1950 | Echols, Sr. et al. | 222/321.9 |
| 2,521,961 | A | * | 9/1950 | Flavius | 222/321.9 |
| 2,547,109 | A | * | 4/1951 | Flavius | 222/385 |
| 2,615,757 | A | * | 10/1952 | Bobrick | 222/190 |
| 2,657,834 | A | * | 11/1953 | Flavius | 222/321.9 |
| 2,772,116 | A | * | 11/1956 | Dobkin | 222/190 |
| 2,878,974 | A | * | 3/1959 | Dobkin | 222/321.7 |
| 2,885,125 | A | * | 5/1959 | Russell | 222/180 |
| 3,216,625 | A | * | 11/1965 | Corsette | 222/182 |
| 3,738,399 | A | * | 6/1973 | Kuhlman | 141/215 |
| 5,332,129 | A | * | 7/1994 | Brattoli et al. | 222/321.7 |

(Continued)

FOREIGN PATENT DOCUMENTS

EP 1 716 934 A2 11/2006

OTHER PUBLICATIONS

International Search Report and Written Opinion issued in PcT/US2012/061772, dated Jan. 29, 2013.

*Primary Examiner* — Patrick M Buechner

(74) *Attorney, Agent, or Firm* — Woodard Emhardt Moriarty McNett & Henry, LLP

(57) ABSTRACT

A pump dispenser for dispensing a liquid product from a container includes an inlet valving arrangement, a plunger and piston arrangement, an outlet valving arrangement and a dispensing nozzle. The dispensing nozzle is a snap-together combination of a unitary, molded plastic nozzle body and a unitary, molded plastic outlet member. The nozzle body defines an exit passageway for the liquid product being dispensed from the container. The outlet member includes an outlet opening and a weir which is positioned between the outlet opening and the exit passageway. Use of the weir affects the exit velocity of the product being dispensed and also provides a barrier so as to prevent remainder or residual product from seeping into or around the outlet opening where it might coagulate.

29 Claims, 6 Drawing Sheets

(56) References Cited

U.S. PATENT DOCUMENTS

| | | | | |
|---|---|---|---|---|
| 5,381,932 | A | 1/1995 | Humphrey | |
| 5,476,197 | A * | 12/1995 | Lawrence et al. | 222/321.7 |
| 5,579,959 | A | 12/1996 | Bennet et al. | |
| 6,082,587 | A | 7/2000 | Martindale et al. | |
| 6,422,434 | B1 | 7/2002 | Lammond Wass et al. | |
| 6,450,373 | B1 | 9/2002 | Seltzer | |
| 6,497,346 | B1 | 12/2002 | Dubois et al. | |
| 6,612,468 | B2 | 9/2003 | Pritchett et al. | |
| 6,695,176 | B1 | 2/2004 | Nazari | |
| 6,698,628 | B2 * | 3/2004 | Mascitelli | 222/491 |
| 6,748,966 | B1 * | 6/2004 | Dvorak | 137/216 |
| 7,168,594 | B2 * | 1/2007 | Law et al. | 222/153.13 |
| 7,549,599 | B2 | 6/2009 | Amron | |
| 7,654,419 | B2 | 2/2010 | Dobbs et al. | |
| 7,748,419 | B2 | 7/2010 | Fink, Jr. et al. | |
| 2005/0167451 | A1 * | 8/2005 | Shimada et al. | 222/321.7 |
| 2005/0189378 | A1 | 9/2005 | Eluck et al. | |
| 2006/0060609 | A1 * | 3/2006 | Dobbs et al. | 222/321.9 |
| 2007/0018015 | A1 * | 1/2007 | Amron | 239/332 |
| 2007/0062974 | A1 * | 3/2007 | Yang et al. | 222/321.9 |
| 2007/0062975 | A1 * | 3/2007 | Yang et al. | 222/321.9 |
| 2009/0039109 | A1 | 2/2009 | Welp | |
| 2009/0188946 | A1 * | 7/2009 | Chien | 222/321.3 |
| 2009/0266848 | A1 * | 10/2009 | Yong et al. | 222/321.7 |
| 2010/0219209 | A1 * | 9/2010 | Ding | 222/321.9 |
| 2010/0230443 | A1 * | 9/2010 | Ding | 222/321.9 |
| 2011/0068198 | A1 * | 3/2011 | Jost | 239/333 |
| 2011/0095055 | A1 * | 4/2011 | Kakuta et al. | 222/321.9 |
| 2011/0101130 | A1 * | 5/2011 | Tseng | 239/333 |

* cited by examiner

PUMP DISPENSER WITH AN INCLINED NOZZLE

BACKGROUND

The present invention, as exemplified by the present disclosure, relates generally to a manually actuated pump dispenser for a liquid product. While the viscosity of an acceptable liquid product for use in the disclosed pump dispenser may extend over a fairly wide range, one of the more important properties or characteristics is that the liquid product have a viscosity so as to be flowable through the corresponding pump mechanism. Some of the fluid products which are considered suitable to be dispensed by the disclosed pump dispenser structure include hand and body lotions, shower gels, liquid soap, food condiments, flavorings and syrups.

One of the concerns with liquid products of the type mentioned above is the potential for a residue remainder to be left in the vicinity of the exit passageway, upstream from the outlet opening of the nozzle, as well as being left in and around the outlet opening of the nozzle. This residue remainder, over time, loses some of its moisture content and typically becomes a gummy layer or glob which remains in the nozzle of the dispenser even during subsequent dispensing strokes for the delivery of additional product.

When a residue builds up at and around the edge of the outlet opening of the nozzle, it is likely that the size of the outlet opening will be reduced and what was a generally circular or cylindrical exit opening now has an irregular edge. One possible result or outcome from the reduced size of the opening due to a gummy residue build up is a higher velocity stream for the exiting product. A smaller stream of exiting product is usually associated with this higher velocity. Another possible result or outcome from this build up is an exiting stream of product which is misdirected, or off-axis due to the irregular edge profile. A higher exit velocity and a dispensing direction which is not only off-axis, but is also random and unpredictable, are disadvantages in almost any setting where dispensers of this type will be used and are disadvantages for almost of any type of product.

It would therefore be an improvement to the type of pump dispensers being discussed herein if the residue remainder could be managed and controlled so as to lessen the likelihood of a residue buildup around the outlet opening of the nozzle. Even if the buildup of a gummy residue within the nozzle cannot be prevented in its entirety, it would still be an improvement to slow down the rate of residue buildup. A further improvement would be to limit the majority of any residue buildup to less critical portions of the nozzle, such as in the exit passageway, upstream from the outlet opening.

The present invention, as exemplified by the present disclosure, addresses the residue buildup issue by the addition of a weir which is placed at a location upstream from the outlet opening of the nozzle. Related to the use of a weir is the overall nozzle shape and geometry. The weir is part of a unitary plastic molding and its presence does not directly impact any other features or components of the pump dispenser in a way which would warrant any modification to the current or existing construction. The desired valving, plunger, piston and cylinder of the pump dispenser, for example, are unaffected by the addition of the weir. Further, the body of the nozzle is constructed and arranged with an incline or inclined shape relative to the plunger axis so that any product which might remain in or around the outlet opening of the nozzle drains back into the exit passageway, away from the outlet opening. Even if some gummy residue might remain in the nozzle, keeping it away from the outlet opening is one of the keys so that there is less or minimal concern about an unacceptable exit velocity and less or minimal concern about any "misdirected" off-axis stream of product as it leaves the outlet opening.

SUMMARY

A pump dispenser for dispensing a liquid product from a container includes an inlet valving arrangement, a plunger and piston arrangement, an outlet valving arrangement and a dispensing nozzle. The dispensing nozzle is a snap-together combination of a unitary, molded plastic nozzle body and a unitary, molded plastic outlet member. The nozzle body defines an exit passageway for the liquid product being dispensed from the container. The outlet member includes an outlet opening and a weir which is positioned between the outlet opening and the exit passageway.

Related objects and advantages will be apparent from the following description.

DESCRIPTION OF THE SELECTED EMBODIMENTS

Figure 1:
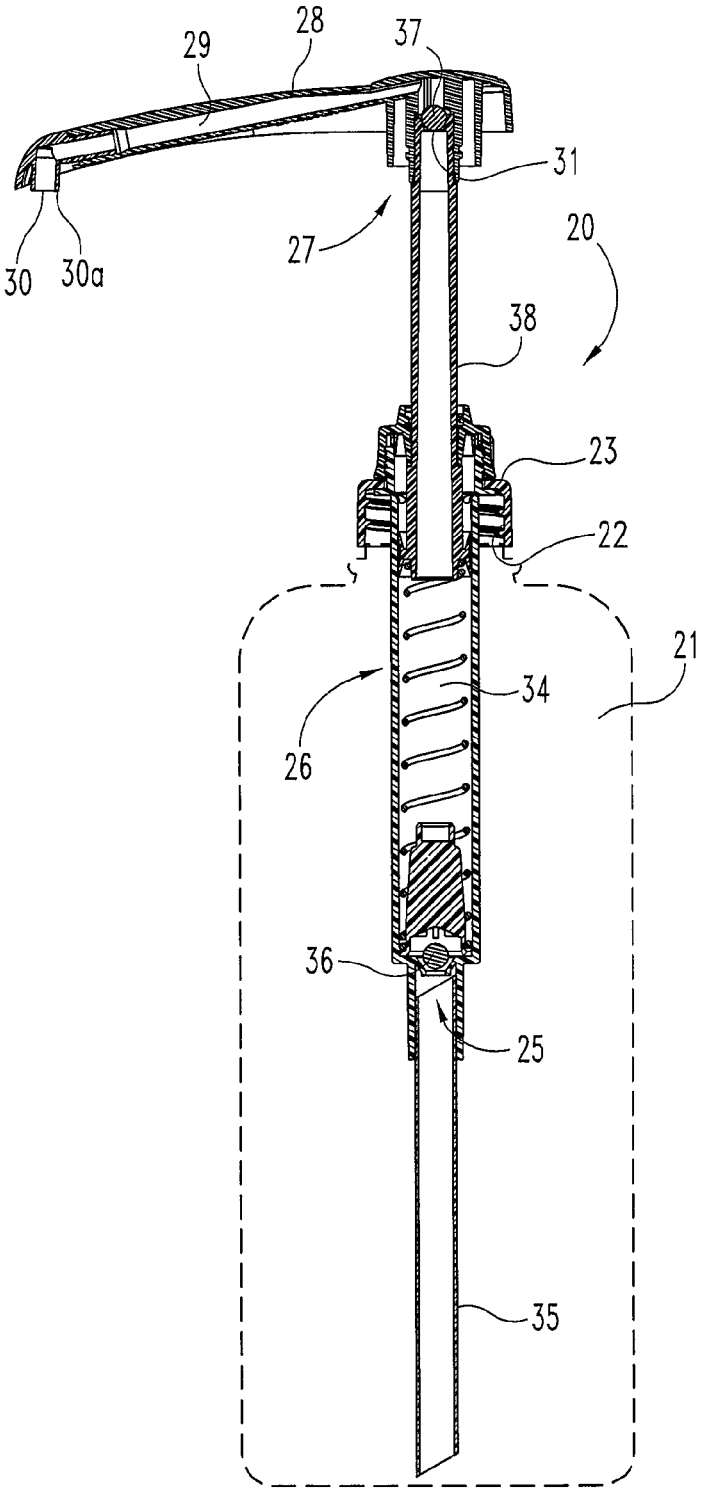
Fig. 1 (PRIOR ART)
FIG. 1 is a front elevational view, in full section, of a prior art pump mechanism for dispensing a product from a container.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Referring to FIG. 1, there is illustrated a prior art pump mechanism 20 which is constructed and arranged for dispensing a liquid product from a container 21 which is only partially illustrated in broken line form for drawing clarity. This style of container 21 typically includes an externally-threaded neck 22 and the closing cap 23 is internally threaded for secure engagement with and attachment to the container neck 22. Once pump mechanism 20 is installed into and attached to a container with liquid product therein, the pump mechanism is able to be manually actuated for dispensing a portion of the liquid product. Since the intended use of pump mechanism 20 is to dispense liquid product, reference is made herein to pump dispenser 20 and this same phrasing is used for the structure (i.e. the pump dispenser) disclosed according to the preferred embodiment and illustrated in FIG. 2.

Pump dispenser 20 includes an inlet valving arrangement 25, a plunger and piston arrangement 26, an outlet valving arrangement 27 and a dispensing nozzle 28. The dispensing nozzle 28 includes and defines an exit passageway 29 and an outlet opening 30. Essentially the hollow passageway 29 which handles the exiting product (i.e. the portion of the liquid product being dispensed with each actuation stroke) structurally extends and includes everything from the outlet ball valve 31 to the outlet opening 30. As such it intended as part of the overall understanding of this disclosure that the outlet opening 30 is generally limited to the circular end edge 30*a* which corresponds to the end of the cylindrical exit of nozzle 28.

The basic use and performance of the prior art pump dispenser 20 is believed to be well known. After any initial priming which may be required and after any preliminary or charging stroke which might be appropriate, the chamber 34 has received and includes a portion of the liquid product which was initially filled into container 21. That portion of product was drawn up from the interior of the container by way of tube 35 into chamber 34 by means of a pressure difference. At this stage, pushing down on nozzle 28 pressurizes the chamber 34 and closes the inlet valve 36 thereby causing that loaded or charged portion of liquid product in chamber 34 to be pushed upwardly against the ball 37 of oulet ball valve 31 which functions as a one-way check valve. Ball 37 is pushed up and the liquid product which was in chamber 34 now flows past the ball into passageway 29 and then ultimately exits by way of outlet opening 30. The upward travel of the spring-biased plunger 38 draws in the next charge of liquid product from the container and stores that next charge in chamber 34.

Ideally, the portion of liquid product which is drawn into chamber 34 with each return stroke would be dispensed in its entirety with the next actuation (downward) stroke of dispensing nozzle 28. It is not unusual though for some small amount of each dispensing charge to be left in the exit passageway 29 and around the outlet opening 30. Even though this remainder amount of the liquid product may be minimal, it can accumulate over time into an amount which creates further issues with the continued use of the dispenser. Considering the remainder product which may be left in the exit passageway and/or around the outlet opening, if the next actuation stroke occurs fairly soon, after completion of the prior actuation stroke, any product residue or remainder which was left behind by the prior actuation stroke is likely still fluid enough to be pushed or drawn out of the exit passageway and dispensed by way of outlet opening 30. While this next actuation stroke might leave its own product residue, there would be no noticeable residue accumulation under the circumstances described when that next actuation stroke occurs fairly soon.

On the other hand, if the next actuation stroke does not occur fairly soon after a residue is left from the prior actuation stroke, that prior residue can be begin to dry out and with many of the likely products to be dispensed with this type of pump dispenser, the residue becomes gummy as it dries out or coagulates. At some point, in view of and due to infrequent use, the prior residue reaches a condition where it cannot be pushed or drawn out of the exit passageway 29 and cannot be automatically cleaned from the outlet opening 30 based solely on the product dispensing action of a subsequent actuation stroke. The gummy residue remains and a new residue layer is applied and this process and the residue buildup can be repeat itself. Another actuation stroke in close time proximity might be able to push out or draw out the newer of the two residues, but the original residue which was deposited and which has now dried to the point of becoming a gummy layer or glob will remain. Over time it is expected that additional residue layers will accumulate in and around outlet opening 30 and along exit passageway 29. As the size of the actual exit opening of outlet opening 30 is reduced due to a residue buildup around the edge of outlet opening 30, the velocity of the exiting product can increase in excess of the intended velocity. As the residue builds up on and around the edge of outlet opening 30 and the size of the actual opening is reduced, the actual exit opening has an irregular shape and is no longer circular nor concentric with the geometric axis of the cylindrical form of outlet opening 30. This means that the exiting stream of product will be somewhat randomly misidirected and squirt out in an off-axis direction and as such may not reach the intended target. The velocity issue and the misdirected exiting stream issue are each addressed by the present invention, as exemplied by the present disclosure, as illustrated in FIGS. 2-6.

Figure 2:
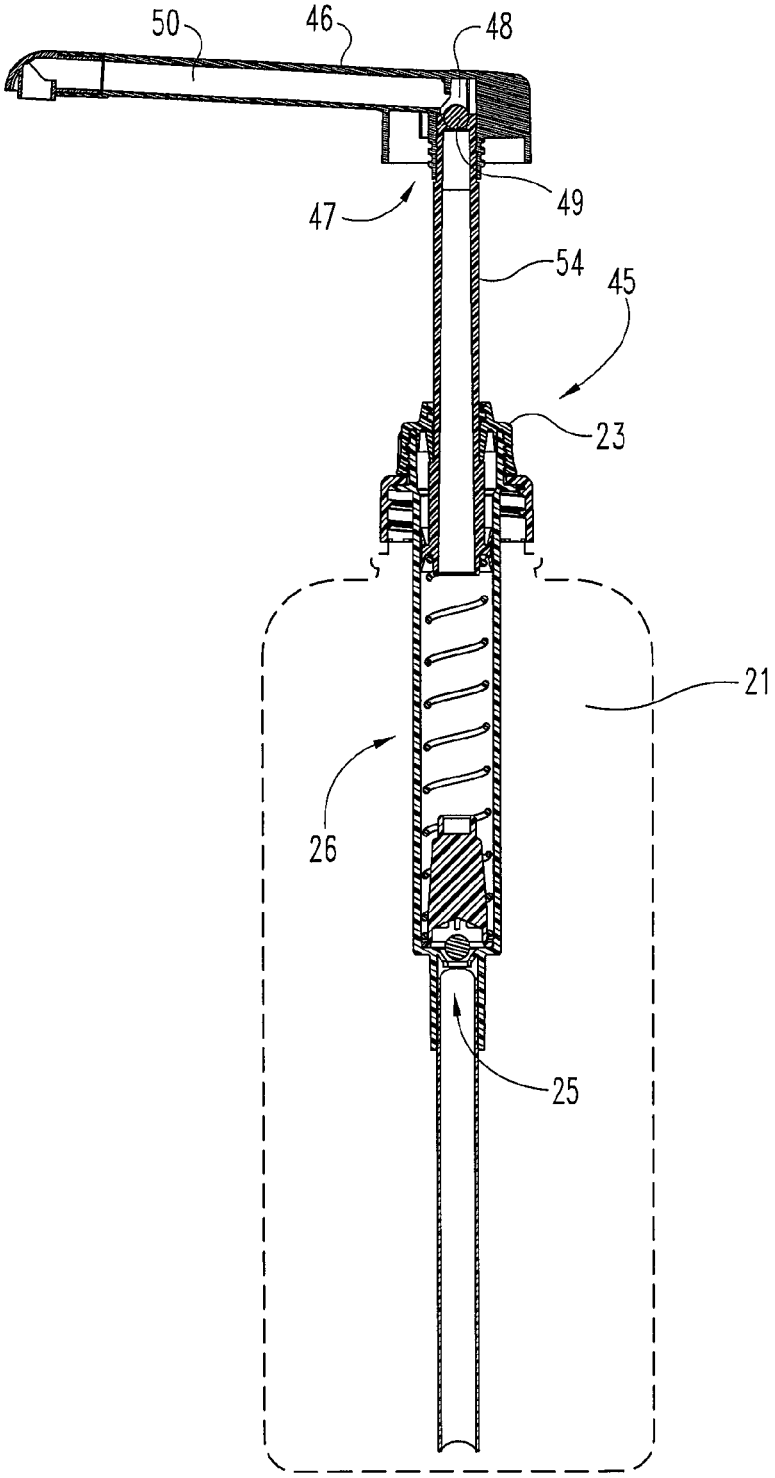
FIG. 2 is a front elevational view, in full section, of a pump mechanism for dispensing product from a container according to the disclosed embodiment.
Figure 3:
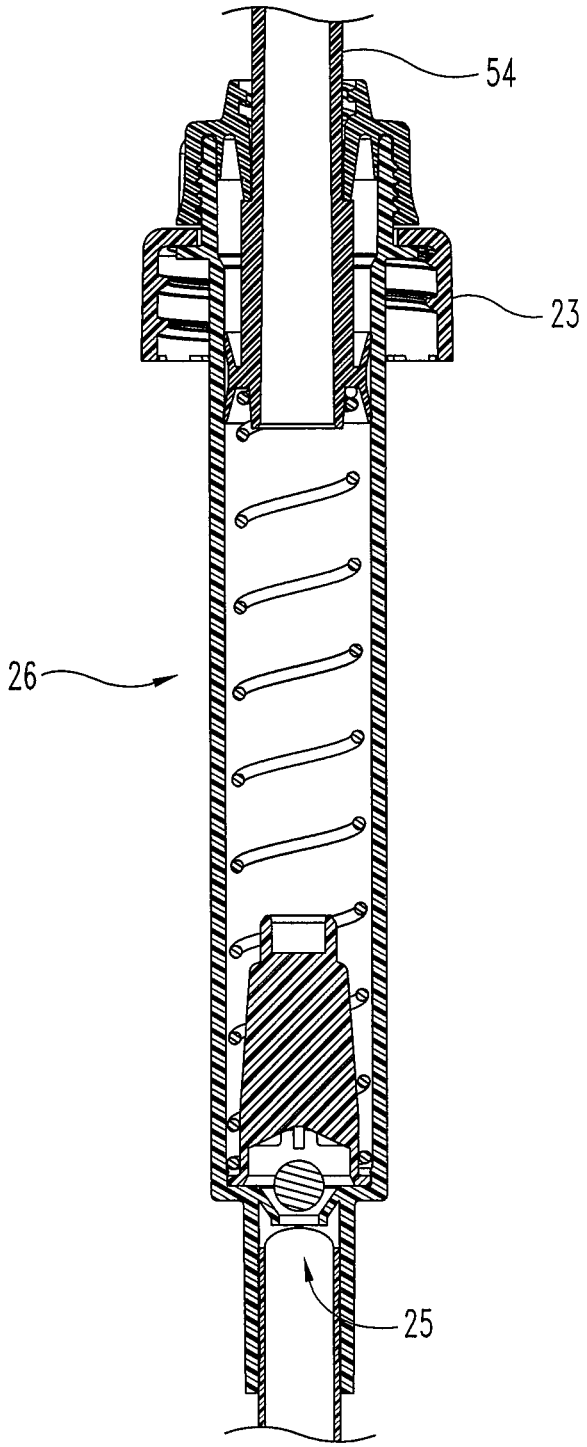
FIG. 3 is a partial, enlarged, full section detail of the FIG. 2 pump mechanism.

Referring to FIG. 2, pump dispenser 45 which is constructed and arranged according to the disclosed embodiment, is illustrated. The construction and arrangement of pump dispenser 45 is essentially the same as that of pump dispenser 20 relative to the inlet valving arrangement 25, the plunger and piston arrangement 26 and the closing cap 23. The container 21 is essentially the same and the liquid products which can be dispensed are essentially the same. In part, these points of similarity are why some of the same reference numbers are being used in both FIGS. 1 and 2. The partial view of FIG. 3 depicts the structural elements, except for container 21, which are the same in the embodiments of FIGS. 1 and 2 wherein FIG. 1 represents the prior art and FIG. 2 represents the present disclosure. The plunger actuation and the sequence of dispening steps associated with each actuation stroke are essentially the same between the two embodiments. All of the novel and unobvious features of the present disclosure are embodied in nozzle 46. While the outlet valving arrangement 47 of FIG. 2 is similar to the outlet valving arrangement 27 of FIG. 1, in the use of a check valve 48 and ball 49. the specific style of the plastic molding of nozzle 46 surrounding the ball 49 is a little different from FIG. 1 and enables an upwardly inclined arrangement for the exit passageway 50 of nozzle 46, as illustrated in FIGS. 2 and 4.

Figure 4:
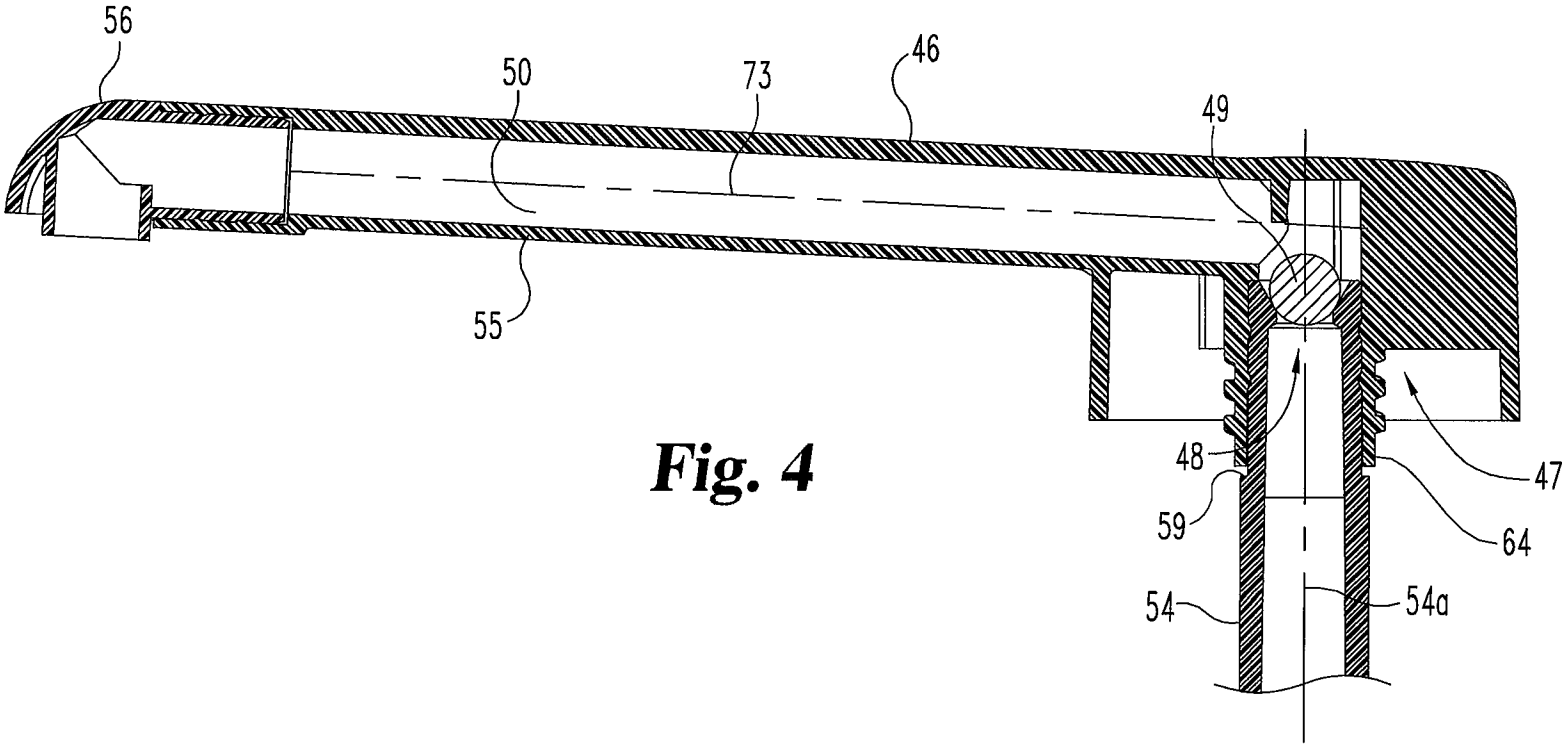
FIG. 4 is an enlarged, side elevational detail, in full section, of a nozzle which comprises one portion of the FIG. 2 pump mechanism.
Figure 5:
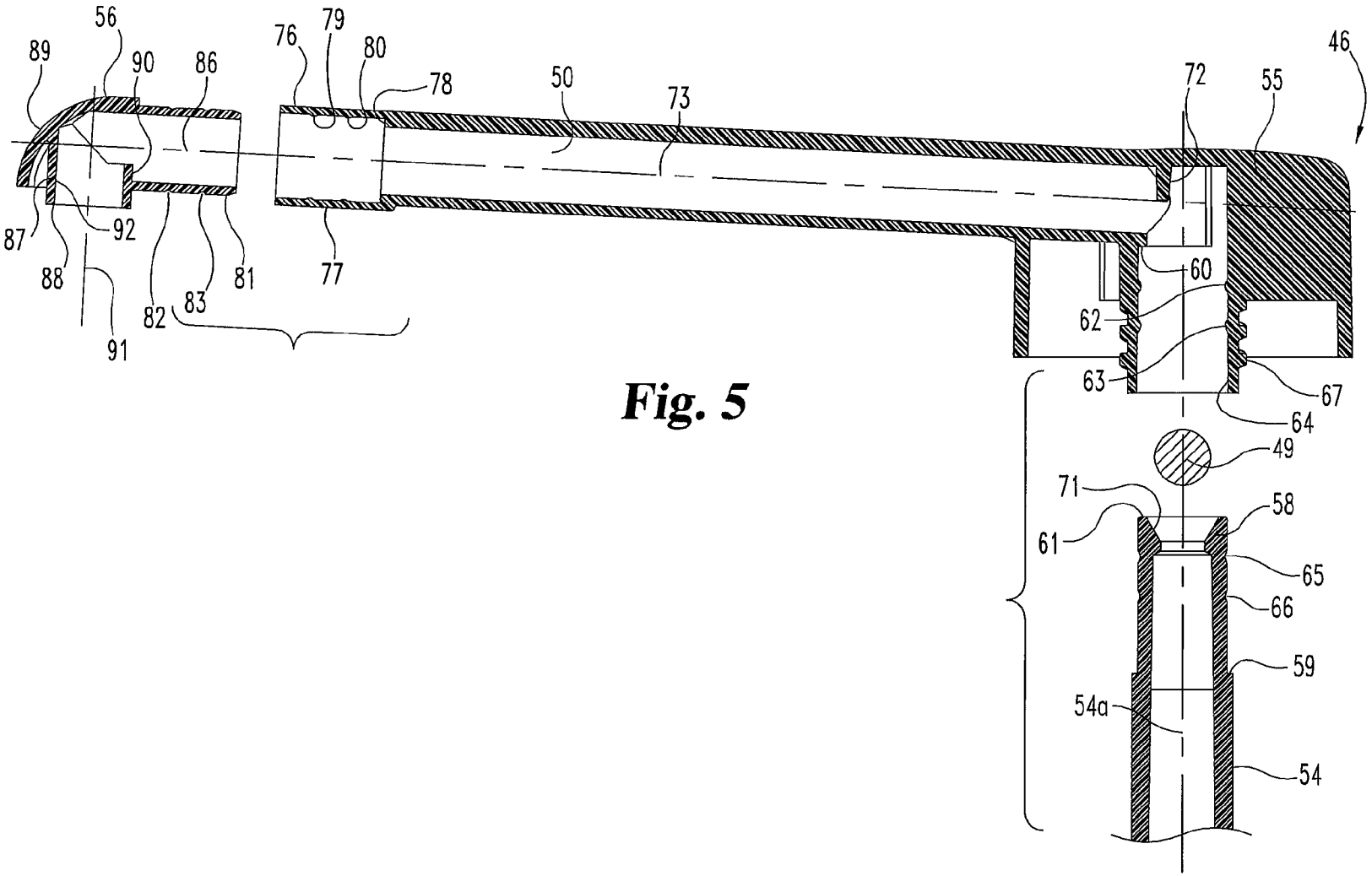
FIG. 5 is an exploded view, in full section, of the FIG. 4 nozzle.

Referring to FIGS. 4 and 5, the nozzle 46 of pump dispenser 45 is illustrated with outlet valving arrangement 47 and as assembled to the upper portion of a hollow plunger 54 which receives ball 49 of the check valve 48. The nozzle 46 which does not actually include either the ball 49 or the plunger 54, is a two-piece plastic molding which snaps together and includes nozzle body 55 and outlet member 56. Nozzle body 55 is constructed and arranged to snap onto the upper portion 58 of plunger 54 with an interference fit and in doing so, is constructed and arranged to capture ball 49 and thereby control the upward travel of ball 49 as it moves due to pressure from the exiting liquid product.

Plunger 54 includes a radial shelf 59 which limits the downward travel of nozzle body 55 when being pushed onto the upper portion 58. Lip 60 of nozzle body 55 seats onto the upper end 61 of plunger 54. In the fully seated condition of FIG. 4, with lip 60 on end 61, the two raised annular ribs 62 and 63 on the interior of the generally cylindrical sleeve 64 snap into the two aligned, recessed annular groves 65 and 66, respectively, which are formed as part of plunger 54. The sleeve 64 is formed with external threads 67 for use in stowing the nozzle in a down position by threaded engagement with the closing cap 23. An exploded view of the FIG. 4 components is provided by FIG. 5. An enlarged drawing of outlet member 56 is provided by FIG. 6.

Plunger 54 has a longitudinal axis represented by line 54*a*. In the normal use of the pump dispenser 45, the container has a generally flat lower surface which rests on a generally horizontal surface such as a countertop. As such, in the typical or normal use orientation, line 54*a* will be generally vertical and generally perpendicular to the top of the corresponding support surface. Plunger 54 is essentially symmetrical about its axial centerline 54*a* including the concentric form of ball valve seat 71.

Nozzle body 55 is a unitary, molded plastic part which is formed as illustrated in FIGS. 4 and 5. In addition to sleeve 64, lip 60, ribs 62 and 63 and threads 67, there is a partial wall 72 which limits the upward travel of ball 49. The space between lip 60 and wall 72 defines an exit opening for the product which is travelling upwardly through the hollow interior of plunger 54. With the ball 49 seated up against the lower end of wall 72, there is flow clearance around the ball for liquid product to flow through exit passageway 50. The longitudinal axis of passageway 50 is defined by centerline 73 and centerline 73 is slightly inclined above horizontal so as to create a slight upward incline in passageway 50 in the direction of outlet member 56.

Considering that the container 21 might not be set on a generally horizontal surface at the time of product dispensing, which means at the time of the downward actuation stroke of nozzle 46, the upward incline of passageway 50 is defined relative to the longitudinal axis 54*a* of plunger 54. As such, the included angle between centerline axis 54*a* and axial centerline 73 is greater than 90 degrees. When the centerline axis 54*a* is generally vertical as would be the normal or expected position for use, the axial centerline 73 is inclined above horizontal, and upwardly inclined as it extends in the direction of outlet member 56. In the preferred embodiment this included angle is approximately 3 degrees above horizontal which means that the included angle is approximately 93 degrees between the two axial centerlines. While the preferred embodiment has an included angle of 93 degrees, the angle of incline is preferably between 1.5 degrees above horizontal and 4.5 degrees above horizontal. If the angle of incline is two great, then there will be a more rapid flow back of any residual product which may be left in passageway 50 and this could affect the movement and travel of the ball 49. If the angle of incline above horizontal is too small, then the more viscous products may not flow backwards along the length of passageway 50, something which is important as further described herein.

The distal end 76 of nozzle body 55 includes a generally cylindrical sleeve portion 77 which is formed with a radial shelf 78 and a pair of inwardly directed, annular ribs 79 and 80. This construction which is similar to sleeve 64, is used for an interference snap-fit with outlet member 56. In a cooperating manner, the generally cylindrical proximal end 81 of outlet member 56 includes annular recessed grooves 82 and 83. When the outlet member 56 is properly inserted and seated into distal end 76, the ribs 79 and 80 engage in snap-fit into grooves 82 and 83, respectively. As is illustrated in FIG. 4, the radial shelf 78 provides a clearance region for receiving proximal end 81 such that the respective inside diameters are substantially flush. This is why the flow via passageway 50 is uninterrupted as it flows into proximal end 81.

Figure 6:
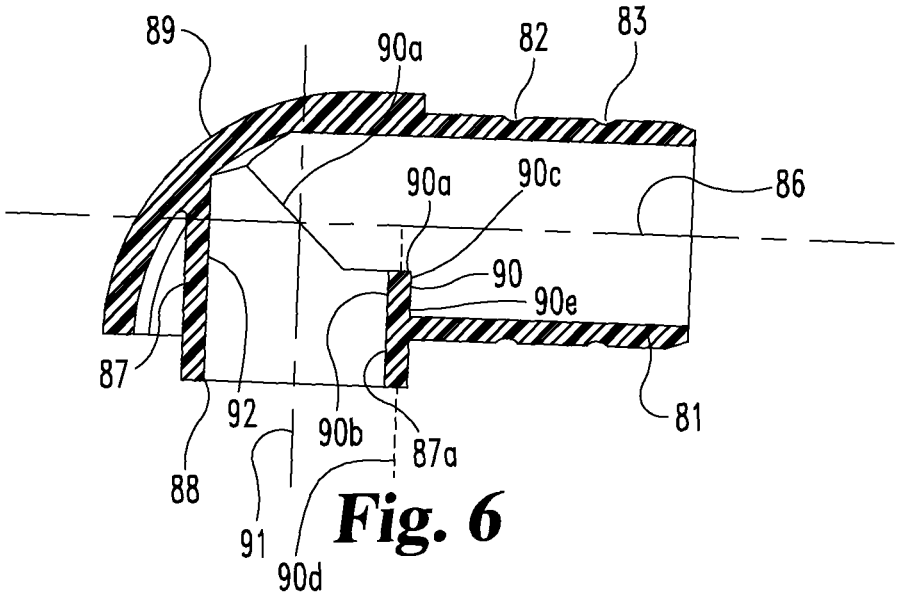
FIG. 6 is a side elevational view, in full section, of an outlet member which comprises one part of a FIG. 4 nozzle.

Outlet member 56 is a unitary, molded plastic component which includes a right angle turn for the dispensing of product. The proximal end 81 has a generally cylindrical sleeve with a longitudinal centerline axis 86 which is generally coincident with axial centerline 73 of exit passageway 50. The remainder of outlet member 56 includes a generally cylindrical outlet sleeve 87, a generally circular outlet opening 88, an outer wall 89 and a weir 90. The axial centerline 91 of outlet sleeve 87 which is generally coincident with the geometric center of outlet opening 88, intersects centerline axis 86 at a substantially right angle. As such, the dispensing flow of product through exit passageway 50 flows, uninterrupted, through sleeve portion 77 and into proximal end 81. Before this dispensing flow of product makes its right angle turn so as to flow out through outlet sleeve 87 and outlet opening 88, some portion of the dispensing flow of product contacts the front surface of weir 90. The annular upper edge of weir 90 is represented by line 90*a*. Weir 90 has a vertical wall 90*c* (i.e. height direction) with a vertical wall centerline 90*d* which is generally parallel with centerline 91 and generally perpendicular to axis 86. As is illustrated in FIGS. 5 and 6, the weir 90 is positioned downstream from the proximal end 81. Weir 90 includes a proximal surface 90*e* facing proximal end 81 and a distal surface 90*b* which is opposed to proximal surface 90e and facing the outlet opening. The entirety of weir 90 as it extends along centerline 90d remains positioned between the outlet opening 88 and centerline 86.

When the flow of product abuts up against the weir 90, the exit velocity of the flowing product is slowed by two events. First, the actual abutment against the weir slows some of the flow and the deflection of some product against other product creates interference and a flow disruption or turbulence which also slows the exit velocity. The exit flow velocity is also slowed by the distal wall 92 of sleeve 87. When the generally horizontal flow, albeit at an incline, hits wall 92, there is a reduction in the exit velocity as the flow of product slows down before making the required turn so as to transition from flow through proximal end 81 to flow out through outlet sleeve 87 and ultimately outlet opening 88. Slowing of the exit velocity of the product being dispensed helps to reduce splatter and splashback either onto the user or onto the surrounding items and surfaces. A second benefit achieved by the use of weir 90 and in part by the inclined nature of exit passageway 50, pertains to the action and effect of any remainder product which might be left in the nozzle after the product dispensing, based on this one actuation stroke, has been completed. There should not be any noticeable residual remainder product left in the outlet sleeve 87 or in the outlet opening 88 due to the exiting flow, gravity and the surface tension of fluids which should draw out any or at least most all of any residual or remaining product.

In the prior art constructions, there is a chance for seepage of remainder product into the outlet opening where it remains, loses moisture and as it coagulates becomes a gummy clog or at least a gummy layer. Even prior art designs with an inclined nozzle will experience some seepage into and around the outlet opening as there is no barrier or restriction between the exit passageway and that outlet opening. In those prior art constructions which do not have an upwardy inclined nozzle, the problem is even greater.

By incorporating a barrier or dam by means of weir 90, any residual or remainder product in exit passageway 50 should be below the height of weir 90 and will be blocked from seeping into and around the outlet sleeve 87 and similarly blocked from clogging any portion of the outlet opening 88. The height of weir 90 is selected to try and anticipate the amount of remainder product which might accumulate layer after layer with continued use. Ideally the volume of product in container 21 is such that it will be exhausted before the top edge of the weir is reached by the accumulating layers of remainder product. This objective is facilitated to some extent by having an inclined nozzle. Any remainder product while still flowable, will gradually flow back down the exit passageway 50 away from weir 90. This reverse flow of any remainder product after each actuation stroke has the potential to gradually build up along the length of exit passageway 50. As already explained, if subsequent activation strokes occur before any remainder product loses moisture and becomes gummy, the next actuation stroke may actually draw out some of that remainder product as part of the dispensing cycle. However, when the time between actuation strokes is longer and any remainder product begins to lose moisture, a gradual buildup along the length of exit passageway 50 should be expected. However, this still means that there is a signficantly larger surface area for the product to build up and thus a thinner layer of remainder product to lose moisture and become gummy. By spreading the residual or remainder product out over a larger surface area, the actual thickness of any buildup layer is less and thus a larger number of layers can be accommodated before reaching the height of weir 90. As such, it is highly unlikely even with extended periods of nonuse between actuation strokes, that there could be a layered accumulation of remainder product which would reach the height of weir 90 before the contents of container 21 are exhausted. If the container 21 is to be refilled, then the pump dispenser 45 can be cleaned at that time so as to remove any of the gummy residue, such as using a pipe cleaner. However, one contemplated use is for container 21 and pump dispenser 45 to be discarded when the intially filled product is exhausted.

The weir 90 is critical to the success of this new pump dispenser design, but the use and benefits of weir 90 are facilitated by the upward incline of the exit passagway 50, leading up to weir 90. One important feature of weir 90 is its coincident construction and positioning relative to cylindrical outlet sleeve 87. The distal surface 90*b* of weir 90 is similarly shaped and flush with the inner generally cylindrical surface 87*a* of outlet sleeve 87. This aligned construction means that there is no lip or edge between surface 90*b* and surface 87*a* which would be able to hold remainder product. If product would be collected on such a lip or ledge, it could seep into the outlet opening 88. The interface or junction between wier 90 and end 81 is similar to what is formed by two (right angle) intersecting cylinders.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A pump dispenser for dispensing a liquid product from a container, said pump dispenser comprising:

an inlet valving arrangement;

a plunger and piston arrangement;

an outlet valving arrangement; and a dispensing nozzle including a nozzle body and an outlet member, said nozzle body defining an exit passageway and said outlet member including a proximal end, an outlet opening and a weir which is positioned between said proximal end and said outlet opening, wherein said outlet member includes a sleeve with a longitudinal centerline and said weir extends along a weir wall centerline such that the entirety of said weir along said weir wall centerline is between said longitudinal centerline and said outlet opening.

2. The pump dispenser of claim 1 wherein said nozzle body is constructed and arranged for a snap-fit receipt of said outlet member.

3. The pump dispenser of claim 2 wherein said snap-fit receipt is an interference fit.

4. The pump dispenser of claim 3 wherein said nozzle body is a unitary, molded plastic component.

5. The pump dispenser of claim 4 wherein said outlet member is a unitary, molded plastic component.

6. The pump dispenser of claim 5 wherein said outlet opening has a centerline axis and said weir is constructed and arranged with an upright wall with a wall centerline which is substantially parallel to the centerline axis of said outlet opening.

7. The pump dispenser of claim 6 wherein said plunger and piston arrangement includes a plunger with a centerline axis and wherein said exit passageway has a centerline axis, and wherein there is an included angle between the centerline axis of said plunger and the centerline axis of said exit passageway, said included angle being greater than 90 degrees.

8. The pump dispenser of claim 7 wherein said included angle is between 92 degrees and 94 degrees.

9. The pump dispenser of claim 1 wherein said nozzle body is a unitary, molded plastic component.

10. The pump dispenser of claim 1 wherein said outlet member is a unitary, molded plastic component.

11. The pump dispenser of claim 1 wherein said outlet opening has a centerline axis and said weir is constructed and arranged with an upright wall with a wall centerline which is substantially parallel to the centerline axis of said outlet opening.

12. The pump dispenser of claim 1 wherein said plunger and piston arrangement includes a plunger with a centerline axis and wherein said exit passageway has a centerline axis, and wherein there is an included angle between the centerline axis of said plunger and the centerline axis of said exit passageway, said included angle being greater than 90 degrees.

13. The pump dispenser of claim 12 wherein said included angle is between 92 degrees and 94 degrees.

14. A dispensing nozzle for snap-on assembly to a dispensing plunger for use in dispensing a product from a container, said dispensing nozzle comprising:

a nozzle body defining an exit passageway; and an outlet member including a proximal end, an outlet opening and a weir which is positioned between said proximal end and said outlet opening, wherein said outlet member includes a sleeve with a longitudinal centerline and said weir extends along a weir wall centerline such that the entirety of said weir along said weir wall centerline is between said longitudinal centerline and said outlet opening.

15. The dispensing nozzle of claim 14 wherein said nozzle body is constructed and arranged for a snap-fit receipt of said outlet member.

16. The dispensing nozzle of claim 15 wherein said snap-fit receipt is an interference fit.

17. The dispensing nozzle of claim 16 wherein said outlet opening has a centerline axis and said weir is constructed and arranged with an upright wall with a wall centerline which is substantially parallel to the centerline axis of said outlet opening.

18. The dispensing nozzle of claim 17 wherein said nozzle body is a unitary, molded plastic component.

19. The dispensing nozzle of claim 18 wherein said outlet member is a unitary, molded plastic component.

20. The dispensing nozzle of claim 14 wherein said outlet opening has a centerline axis and said weir is constructed and arranged with an upright wall with a wall centerline which is substantially parallel to the centerline axis of said outlet opening.

21. A pump dispenser for dispensing a liquid product from a container, said pump dispenser comprising:

an inlet valving arrangement;

a plunger and piston arrangement;

an outlet valving arrangement; and a dispensing nozzle including a nozzle body and an outlet member, said nozzle body defining an exit passageway and said outlet member including a proximal end, an outlet opening and a weir which is positioned between said proximal end and said outlet opening, wherein said outlet member includes an outlet sleeve and wherein said weir has a distal surface which is substantially flush with an inner surface of said outlet sleeve.

22. A dispensing nozzle for assembly to a dispensing plunger for use in dispensing a product from a container, said dispensing nozzle comprising:

a nozzle body defining an exit passageway; and an outlet member including a proximal end, an outlet opening and a weir which is positioned between said proximal end and said outlet opening, wherein said outlet member includes an outlet sleeve and wherein said weir has a distal surface which is substantially flush with an inner surface of said outlet sleeve.

23. A dispensing nozzle for use in dispensing a product from a container, said dispensing nozzle comprising:

a nozzle body defining an exit passageway and including a radial shelf at a distal end; and an outlet member inserted and seated into said distal end, said outlet member including a proximal end, an outlet opening, a centerline and a weir which is positioned below said centerline between said proximal end and said outlet opening, wherein said outlet member centerline is a longitudinal centerline and said weir extends along a weir wall centerline such that the entirety of said weir along said weir wall centerline is between said longitudinal centerline and said outlet opening.

24. The dispensing nozzle of claim 23 wherein said nozzle body and said outlet member are constructed and arranged for uninterrupted product flow from said nozzle body into said outlet member.

25. The dispensing nozzle of claim 23 wherein said outlet opening has a centerline axis and said weir is constructed and arranged with an upright wall with a wall centerline which is substantially parallel to the centerline axis of said outlet opening.

26. An outlet member for assembly to a nozzle body for use in dispensing product from a container, said outlet member comprising:

a first end constructed and arranged for assembly to said nozzle body;

a second end defining an outlet opening; and a weir positioned between said first end and said second end, wherein said outlet member further includes an outlet sleeve and wherein said weir has a distal surface which is substantially flush with an inner surface of said outlet sleeve.

27. The outlet member of claim 26 wherein said outlet member defines a centerline axis and said weir is constructed and arranged with an upright wall with a wall centerline which is substantially parallel to the centerline axis of said outlet member.

28. An outlet member for assembly to a nozzle body for use in dispensing product from a container, said outlet member comprising:

a first end constructed and arranged for assembly to said nozzle body;

a second end defining an outlet opening; and a weir positioned between said first end and said second end, wherein said weir includes a proximal surface facing said first end and an opposed distal surface facing said outlet opening.

29. The outlet member of claim 28 wherein said outlet member defines a centerline axis and said weir is constructed and arranged with an upright wall with a wall centerline which is substantially parallel to the centerline axis of said outlet member.

* * * * *